US008596106B2

(12) United States Patent
Tang et al.

(10) Patent No.: US 8,596,106 B2
(45) Date of Patent: Dec. 3, 2013

(54) ISOTHERMAL FORMING SYSTEM FOR PRODUCTION OF SHEET METAL PARTS

(75) Inventors: Chak Yin Tang, Kowloon (CN); Tai Chiu Lee, Kowloon (CN); Luen Chow Chan, Kowloon (CN); Nga Yung Ng, Kowloon (CN)

(73) Assignee: The Hong Kong Polytechnic University, Kowloon (HK)

( * ) Notice: Subject to any disclaimer, the term of this patent is extended or adjusted under 35 U.S.C. 154(b) by 559 days.

(21) Appl. No.: 12/153,539

(22) Filed: May 21, 2008

(65) Prior Publication Data

US 2009/0288466 A1 Nov. 26, 2009

(51) Int. Cl.
*B21D 37/16* (2006.01)

(52) U.S. Cl.
USPC ..... 72/342.8; 72/56; 72/342.1; 72/342.5

(58) Field of Classification Search
USPC ..... 72/41, 42, 54, 56, 57, 60, 342.2, 342.3, 72/342.4, 342.5, 342.7, 342.8, 342.1; 29/421.1; 148/646, 647
See application file for complete search history.

(56) References Cited

U.S. PATENT DOCUMENTS

| | | | | | |
|---|---|---|---|---|---|
| 796,970 | A * | 8/1905 | Hoopes | 72/57 |
| 1,061,721 | A * | 5/1913 | Beaumont et al. | 266/116 |
| 1,346,946 | A * | 7/1920 | Fay | 148/646 |
| 2,340,724 | A * | 2/1944 | Zur Horst et al. | 148/637 |
| 2,783,815 | A * | 3/1957 | Tegarden | 72/396 |
| 3,064,710 | A * | 11/1962 | Willis | 72/57 |
| 3,163,141 | A * | 12/1964 | Wesley et al. | 72/56 |
| 3,286,337 | A * | 11/1966 | Sauve | 29/423 |
| 3,383,891 | A * | 5/1968 | Geitz | 72/57 |
| 3,440,708 | A * | 4/1969 | Zoiss et al. | 29/419.1 |
| 3,516,274 | A * | 6/1970 | Lew et al. | 72/57 |
| 3,585,836 | A * | 6/1971 | Tate et al. | 72/384 |
| 3,703,093 | A * | 11/1972 | Komatsu et al. | 72/342.4 |
| 3,988,914 | A | 11/1976 | Metcalfe et al. | |
| 4,314,468 | A * | 2/1982 | Baril et al. | 72/57 |
| 4,472,955 | A * | 9/1984 | Nakamura et al. | 72/57 |
| 4,536,226 | A * | 8/1985 | Ohtake et al. | 148/621 |
| 4,616,499 | A | 10/1986 | Gray | |
| 5,042,281 | A | 8/1991 | Metcalfe | |
| 5,119,535 | A * | 6/1992 | Gnagy et al. | 29/469.5 |
| 5,242,102 | A * | 9/1993 | Nicolas | 228/193 |
| 5,376,186 | A * | 12/1994 | Uchida et al. | 148/29 |
| 5,433,099 | A * | 7/1995 | Katsuhiro et al. | 72/347 |
| 5,950,468 | A * | 9/1999 | Shimizu et al. | 72/41 |
| 6,059,904 | A | 5/2000 | Benz et al. | |
| 6,908,519 | B2 | 6/2005 | Raymond et al. | |
| 7,254,977 | B2 * | 8/2007 | Machrowicz et al. | 72/342.3 |
| 7,266,982 | B1 * | 9/2007 | Guza | 72/60 |
| 7,851,422 | B2 * | 12/2010 | Ichitani et al. | 508/591 |

FOREIGN PATENT DOCUMENTS

| | | | | |
|---|---|---|---|---|
| JP | 5-76977 | * | 3/1993 | B21J 1/06 |

* cited by examiner

*Primary Examiner* — Edward Tolan
(74) *Attorney, Agent, or Firm* — Muncy, Geissler, Olds & Lowe, PLLC

(57) ABSTRACT

The present invention relates to an apparatus for attachment to a conventional sheet metal forming press. The apparatus allows the sheet metal forming process to be preformed fully submerged in an oil. Methods for sheet metal forming in oil are also provided.

6 Claims, 3 Drawing Sheets

FIG. 3

ISOTHERMAL FORMING SYSTEM FOR PRODUCTION OF SHEET METAL PARTS

BACKGROUND

Isothermal forging is a metal-forming process developed since the 1960s. Isothermal forging requires dies, usually heated, to be kept at the same temperature at the work piece when forging. It has been used as an effective way of achieving highly desired thin walled and quality drawn products. The implementation of isothermal forging requires a custom-made production line or equipment to maintain a uniform elevated forming temperatures and prevent oxidation of the part being formed. Equipment incapable of satisfying these requirements will significantly lower the process formability and cause formation of oxide/scale on the product surface.

Several developments have attempted to address a non-uniform raised temperature. U.S. Pat. No. 4,616,449 teaches a method of fabricating products wherein an alloy is thermo-chemically treated before forging occurs. U.S. Pat. No. 6,908,519 teaches heating an alloy to a high temperature and then forging at that temperature. Another method, U.S. Pat. No. 6,059,904, teaches combining isothermal forging, selecting a suitable blank or preform, subsolvus forging, and annealing. However, the prior art fails to address a consistent temperature through the blank or preform, nor the difference in temperature between the die 101 and the blank or preform.

It is an object of the present invention to overcome the disadvantages and problems in the prior art.

DESCRIPTION

The present invention relates to an apparatus for implanting the sheet metal forming process in a bath of heat transfer oil. In one embodiment, the punch, die, and blank or preform are submerged in an exothermic bath at a steady raised temperature during the forming process. In this embodiment, the process is auto-lubricated. Through the invention, the tool life is prolonged, and formability enhanced. Further, the apparatus is a self-contained system, allowing minimization of production cost.

These and other features, aspects, and advantages of the apparatus and methods of the present invention will become better understood from the following description, appended claims, and accompanying drawings where:

The following description of certain embodiment(s) is merely exemplary in nature and is in no way intended to limit the invention, its application, or uses. Throughout this specification, the term "blank" shall refer to a metal piece that has not yet been treated. The term "preform" shall refer to a metal that has undergone preliminary treatment, but is not yet in final form.

Figure 1:
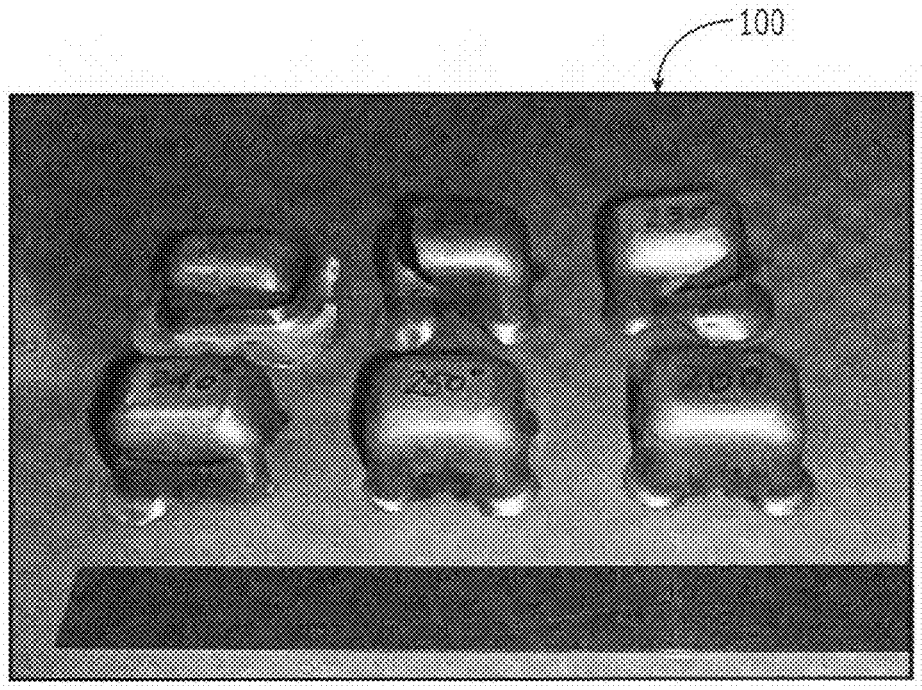
FIG. 1 shows formed products from the present system.
Figure 2:
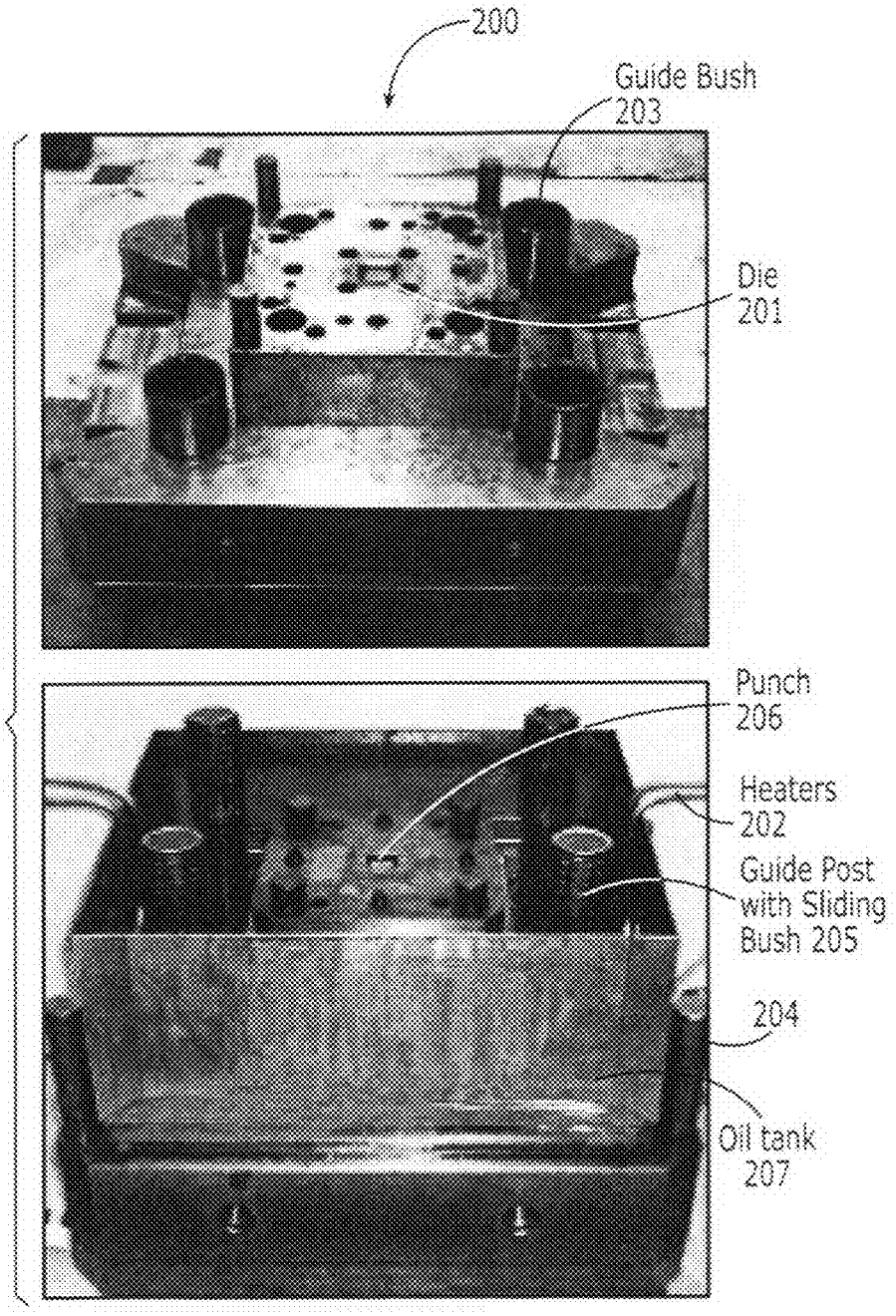
FIG. 2 shows an embodiment of the present invention, wherein pressing occurs in a completely oil submerged environment.
Figure 3:
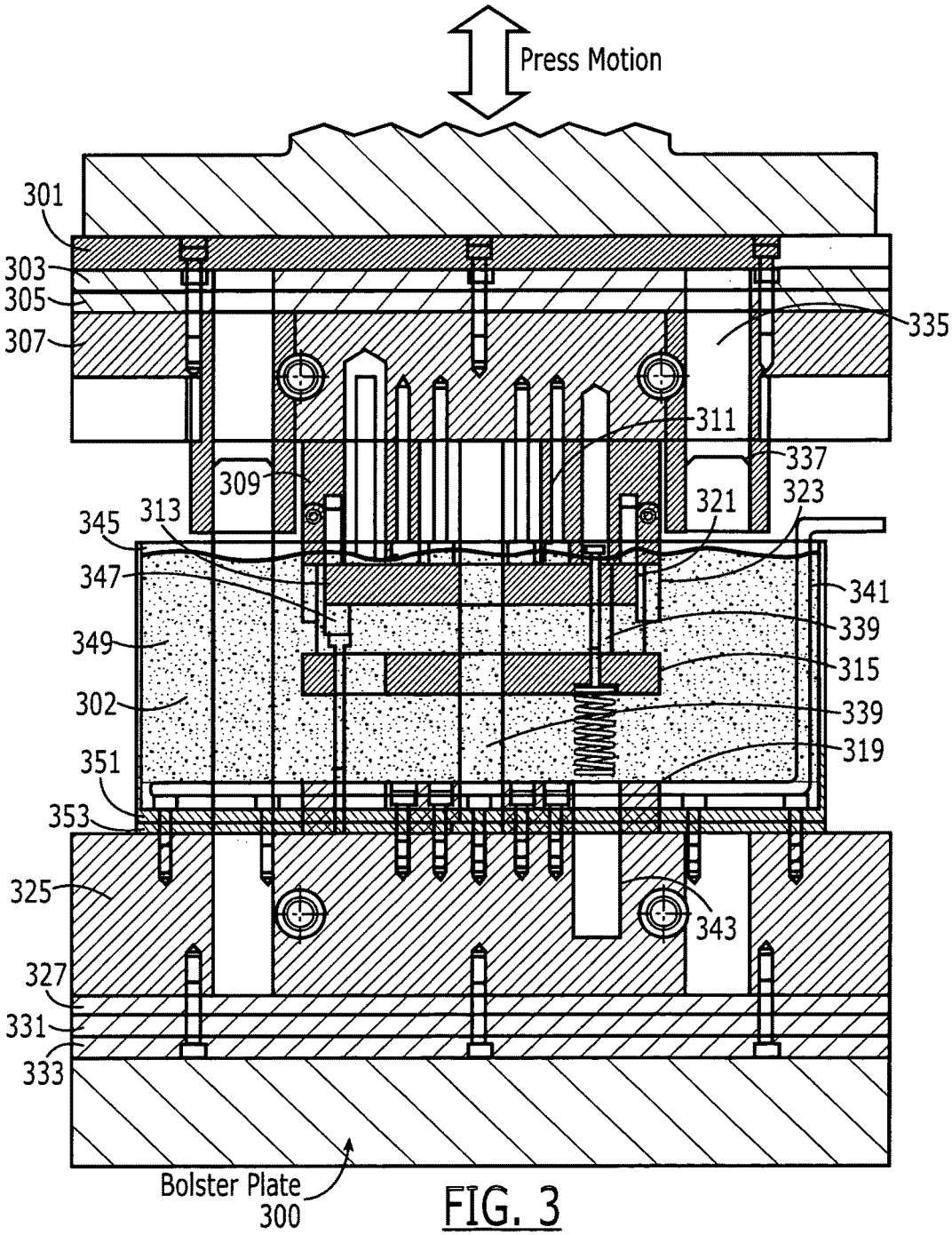
FIG. 3 is a schematic of the fully submerged press apparatus of the present invention.

Now, to FIGS. 1-3,

FIG. 1 exhibits several alloy cups 100 manufactured by the present system. Whereas all cups were manufactured fully submerged in isothermally heated transfer oil, the temperature of the oil is important for the constituency of the final product.

FIG. 2 is an embodiment of a system of the present invention. The system is made from two primary units, a top unit 200 (upside down) and a bottom unit 204. The top unit 200 includes a die 201 for forming a variety of products and components.

With regard to the present system, the press may be mechanically or hydraulically operated. Via the bottom unit 204, a stable, raised temperature can be maintained between the die and blank or preform, and throughout the blank or preform. The bottom unit 204 includes sliding bushings 205, an oil tank 207, and heaters 202.

In use, the tank is filled with a heat transfer oil, submerging all components including the punch 206, die 201, and the blank or preform (not shown). The oil is heated via the heaters 202, to between 210° C. to 270° C., preferably 250° C. to about 260° C. Because the components involved in formation are fully submerged in the heat transfer oil, an isothermal environment is created with small temperature variations. Additionally, by fully submerging components, the benefits of anti-oxidation and lubrication are obtainable. The present invention is useful with blanks and preforms made from alloys of magnesium, aluminum, zinc, copper, tin, and lead.

FIG. 3 is a schematic of an apparatus embodiment of the present invention, used in conjunction with a conventional press. From the bolster plate 300 up, the apparatus comprises several layers of insulation 333/331/327 sandwiched underneath a lower die shoe 325; a joint plate 353 is positioned adjacent to the base of the oil tank 351. As stated, the oil tank 351 is positioned around the punch 319, allowing the punch 319, die, and blank or preform to be fully submerged in oil 302. The oil 302 can be heat transfer oil well-known in the art, for example #281 Heat Transfer Oil (Schaeffr Manufacturing, Missouri) or D-A Heat Transfer Oil No. 300 (D-A Lubricant, IN). The oil 302 can be a 100% paraffinic heat transfer fluid or a blend, such as paraffin with polyalphaolefin. Blends can include synthetics, hot oil, and silicones. Synthetics can include diphenyl oxide/biphenyl fluids, diphenylethanes, dibenzyltoluenes, and terphenyls. Hot oils can include parafinnic and napthoic hydrocarbon. The heat transfer oil 302 should maintain it's stability up to 400° C.

The sides of the tank 345/349 extend to slightly below the bushings 337. The inner workings of the apparatus includes, but is not limited to, punch holder 317, strippers 315/313, springs 339, pressure pins 321, depth indicators 323, columns 347, and the like. The tank shall further include a heating coil 341 for increasing the temperature of the heating oil 302.

The top side of the apparatus can include die components such as inserts 311, backing plates 304, as well as upper die shoe 307, insulation 303/305, and backing plate 301.

Having described embodiments of the present system with reference to the accompanying drawings, it is to be understood that the present system is not limited to the precise embodiments, and that various changes and modifications may be effected therein by one having ordinary skill in the art without departing from the scope or spirit as defined in the appended claims.

In interpreting the appended claims, it should be understood that:

a) the word "comprising" does not exclude the presence of other elements or acts than those listed in the given claim;

b) the word "a" or "an" preceding an element does not exclude the presence of a plurality of such elements;

c) any reference signs in the claims do not limit their scope;

d) any of the disclosed devices or portions thereof may be combined together or separated into further portions unless specifically stated otherwise; and e) no specific sequence of acts or steps is intended to be required unless specifically indicated.

The invention claimed is:

1. An apparatus for isothermal forming of sheet metal products having a small or intricate shape, comprising:

a sheet metal forming press;

an oil tank;

a punch;

heaters provided in the oil tank;

a die, wherein the die has an upper die shoe and a lower die shoe, the oil tank being disposed on top of the lower die shoe via a joint plate; and non-pressurized heat transfer oil, wherein said oil tank contains a predetermined amount of the non-pressurized heat transfer oil to fully submerge said punch, said die, and a blank or preform;

wherein the temperature of the blank or preform is increased by the heat transfer oil, and wherein the blank or preform is deformed by direct force generated by the punch and die in the heat transfer oil that has been heated.

2. The apparatus according to claim 1, further comprising a blank or preform selected from the group consisting of magnesium, aluminum, zinc, copper, tin, and lead, wherein said blank or preform is fully submerged in said oil tank.

3. The apparatus according to claim 1, wherein said heat transfer oil is either a 100% paraffinic fluid or a blend.

4. The apparatus according to claim 3, wherein said heat transfer oil maintains a stable temperature up to 400° C.

5. The apparatus according to claim 4, wherein said heat transfer oil maintains a stable temperature from 210° C. to 270° C.

6. The apparatus according to claim 4, wherein said heat transfer oil maintains a stable temperature from 250° C. to about 260° C.

* * * * *

UNITED STATES PATENT AND TRADEMARK OFFICE

CERTIFICATE OF CORRECTION

PATENT NO. : 8,596,106 B2
APPLICATION NO. : 12/153539
DATED : December 3, 2013
INVENTOR(S) : Tang et al.

It is certified that error appears in the above-identified patent and that said Letters Patent is hereby corrected as shown below:

On the Title Page, Item 73

Adding the 2nd Assignee:

Ameroll Metal Products Company Limited, Kowloon (HK)

Signed and Sealed this
Fourth Day of March, 2014

Michelle K. Lee

Michelle K. Lee
*Deputy Director of the United States Patent and Trademark Office*